US005992762A

United States Patent [19]

Wang

[11] Patent Number: 5,992,762

[45] Date of Patent: Nov. 30, 1999

[54] FULL FLOW OPENING STRUCTURE OF GARDENING-USED FIGURE SPRINKLING HEAD

[75] Inventor: King-Yuan Wang, Changhua Hsien, Taiwan

[73] Assignee: Yuan Mei Corp., Changhua Hsien, Taiwan

[21] Appl. No.: 09/108,254

[22] Filed: Jul. 1, 1998

[51] Int. Cl.[6] ..... B05B 1/16

[52] U.S. Cl. ..... 239/394; 239/446

[58] Field of Search ..... 239/394, 392, 239/391, 390, 540, 538, 537, 526, 525, 446

[56] References Cited

U.S. PATENT DOCUMENTS

| | | | |
|---|---|---|---|
| 4,909,443 | 3/1990 | Takagi | 239/538 X |
| 5,232,162 | 8/1993 | Chih | 239/394 |
| 5,501,400 | 3/1996 | Kuo | 239/394 |
| 5,566,886 | 10/1996 | Wang | 239/394 |
| 5,598,978 | 2/1997 | Wang | 239/394 |
| 5,772,121 | 6/1998 | Wang | 239/394 |
| 5,823,442 | 10/1998 | Guo | 239/394 |
| 5,873,531 | 2/1999 | Wang | 239/394 |

*Primary Examiner*—Lesley D. Morris
*Attorney, Agent, or Firm*—Bacon & Thomas, PLLC

[57] ABSTRACT

A full flow opening structure of gardening-used figure sprinkling head, including a sprinkling gun connected with a figure sprinkling head, the sprinkling head being composed of a figure water discharging cover and a bottom cap watertightly fused with each other by ultrasonic wave. A conic post formed with thread hole being disposed at a center of interior of the sprinkling gun. An inner periphery of the water discharging cover is formed with multiple radially arranged ribs for connecting with a circular screen plate. A full flow opening is defined between the ribs. The exit of each full flow opening is disposed with an inclined flange. The periphery of the screen plate is disposed with a rearward extending annular partitioning board. The partitioning board and the inner wall of the water discharging cover define therebetween a full flow water passage. An inner portion of the screen plate is disposed with several different annularly arranged figure sprinkling holes and two blind faces. Each figure sprinkling hole has a rearward extending hollow post. One of the blind faces has a rearward extending full flow opening guide flange shaped as a balloon flask and connecting with the partitioning board of the screen plate and communicated with the full flow water passage. The full flow opening at the exit of the guide flange is closed.

2 Claims, 3 Drawing Sheets

FULL FLOW OPENING STRUCTURE OF GARDENING-USED FIGURE SPRINKLING HEAD

BACKGROUND OF THE INVENTION

The present invention relates to a full flow opening structure of gardening-used figure sprinkling head, in which the exit of the full flow opening of the water discharging cover is disposed with an inclined flange. The back face of the screen plate of the water discharging cover is disposed with a full flow opening guide flange shaped as a balloon flask. By means of the head section guide flange, the water flowing through the water entrance of the bottom cap will evenly collectively flow to the inner wall of the water discharging cover. The water is guided by the inclined flange at the exit of the full flow opening to evenly scatter flow to the respective full flow openings and smoothly discharge in an even weak state.

In a conventional full flow opening structure of gardening-used figure sprinkling head, the head section of the sprinkling gun is connected with a figure sprinkling head which is composed of a figure water discharging cover and a bottom cap watertightly fused with each other by ultrasonic wave. A stepped post disposed at a center of interior of the sprinkling gun is passed through a central through hole of the figure sprinkling head and connected therewith by a screw. A water exit and a locating hole are formed in the sprinkling gun. A spring pin is inserted in the locating hole. Several ribs are disposed in the exit of the water passage and spaced from an end face thereof by a certain distance. A water sealing O-ring is disposed in the water passage by the distance. An inner periphery of the water discharging cover is formed with multiple radially arranged connecting ribs for connecting with a circular screen plate. An inner portion of the screen plate is disposed with six different annularly arranged figure sprinkling holes and two blind holes. Each figure sprinkling hole has an inward extending hollow post abutting against six figure water entrances of the bottom cap. The outer periphery of the bottom cap abuts against the periphery of the screen plate and spaced from the connecting ribs by a certain distance, permitting the water to flow through the full flow opening. Then the bottom cap is fused with the screen plate by ultrasonic wave to form the figure sprinkling head. In addition to the six water entrances, the bottom cap has a fine mesh water inlet. A back face of the bottom cap is formed with several locating recesses corresponding to the water entrances. The sprinkling head is rotarily adjustable to fit the locating spring pin into the locating recess of the bottom cap so as to align the water entrance of the bottom cap with the exit of the water passage. The 0-ring serves to achieve a watertightly sealing effect and the water is guided and discharged from the sprinkling head.

In addition to the six water entrances and the fine mesh water inlet, the back face of the bottom cap is disposed with a full flow flange shaped as a balloon flask to define a recess. The sprinkling head can be freely rotated to align any water entrance with the water passage of the sprinkling gun to sprinkling water in a figure pattern or a mesh pattern. Moreover, the full flow flange can be aligned with the water passage to expose a rectangular section of the recess for guiding the water into the sprinkling gun to flow out from the full flow opening between the connecting ribs and all the sprinkling openings in a weak flow state.

The above structure has a shortcoming as follows:

When the sprinkling head is switched to discharge the water from the full flow opening, the water tends to collectively flow out from the full flow opening of the lower half section of the water discharging cover. Therefore, the water cannot be evenly and smoothly discharged.

SUMMARY OF THE INVENTION

It is therefore a primary object of the present invention to provide a full flow opening structure of gardening-used figure sprinkling head, in which the full flow opening guide flange of the water discharging cover is shaped as a balloon flask. By means of the head section guide flange, the water flowing through the water entrance of the bottom cap will evenly collectively flow to and impact the inner wall of the water discharging cover and laterally flow and evenly enter the full flow water passage. The water is guided by the inclined flange at the exit of the full flow opening to evenly scatter flow to the respective full flow openings and smoothly discharge in an even weak state.

The present invention can be best understood through the following description and accompanying drawings, wherein:

DETAILED DESCRIPTION OF THE PREFERRED EMBODIMENT

Figure 1:
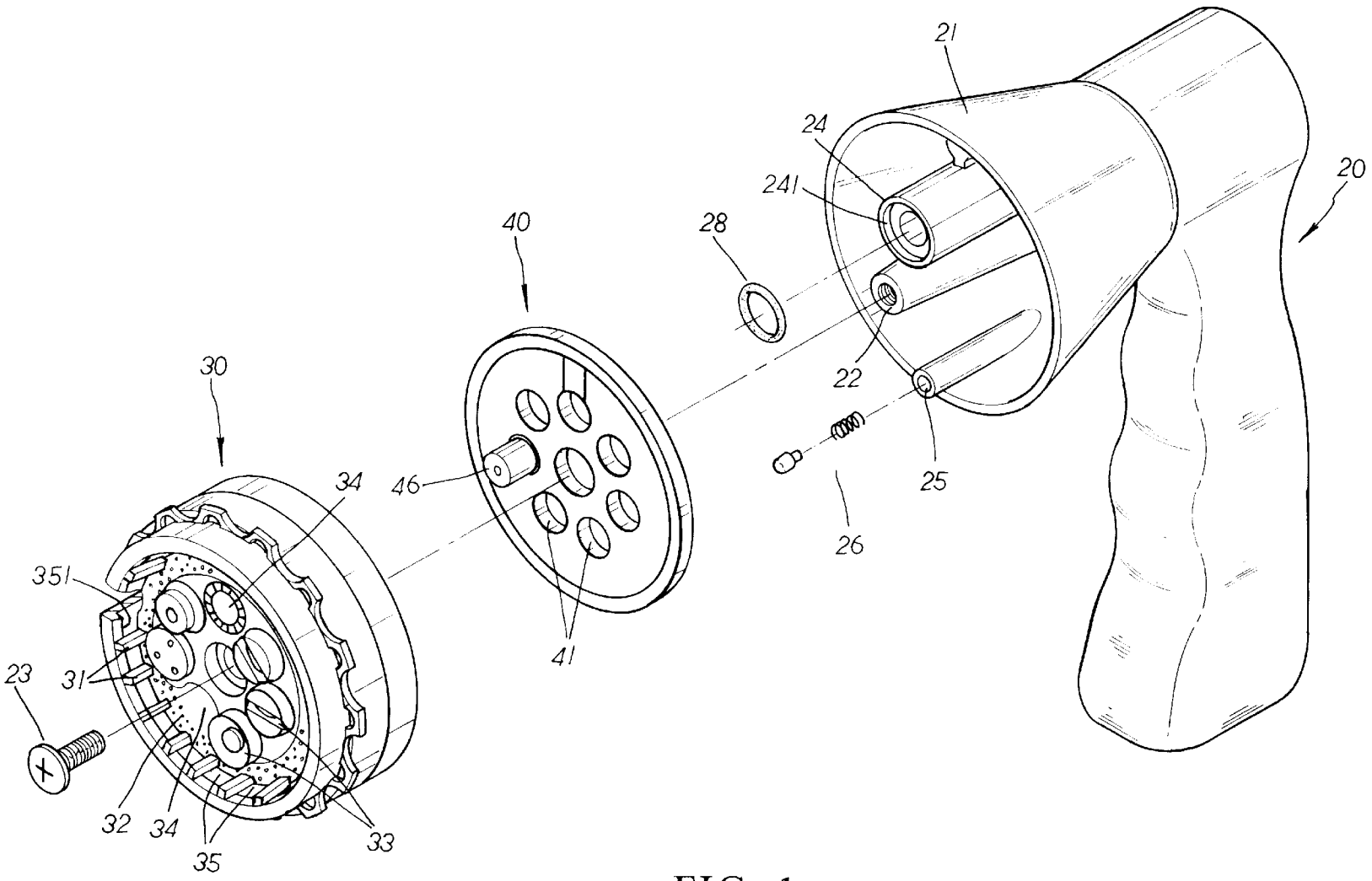
FIG. 1 is a perspective exploded view of the present invention.
Figure 2:
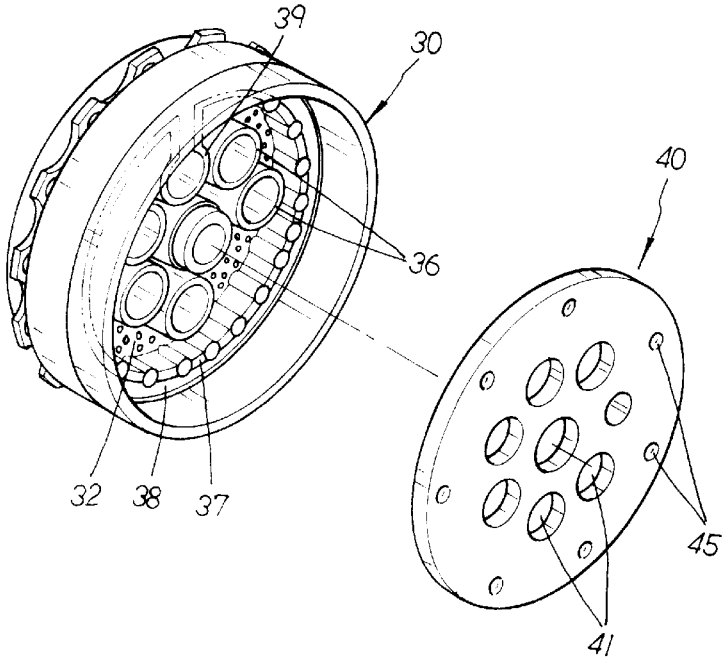
FIG. 2 is a back perspective exploded view of the water discharging cover and bottom cap of the present invention.
Figure 4:
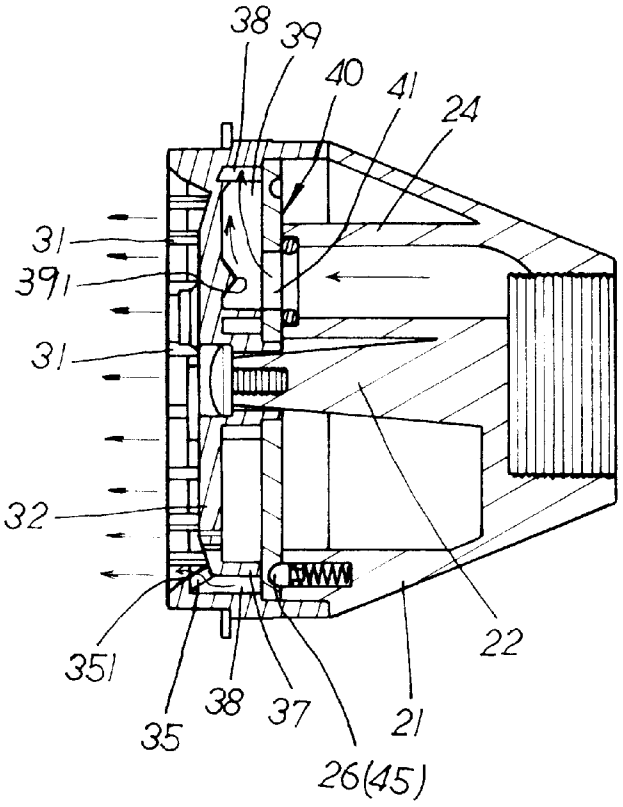
FIG. 4 is a sectional view showing that the water is discharged from the full flow opening of the present invention.
Figure 4:
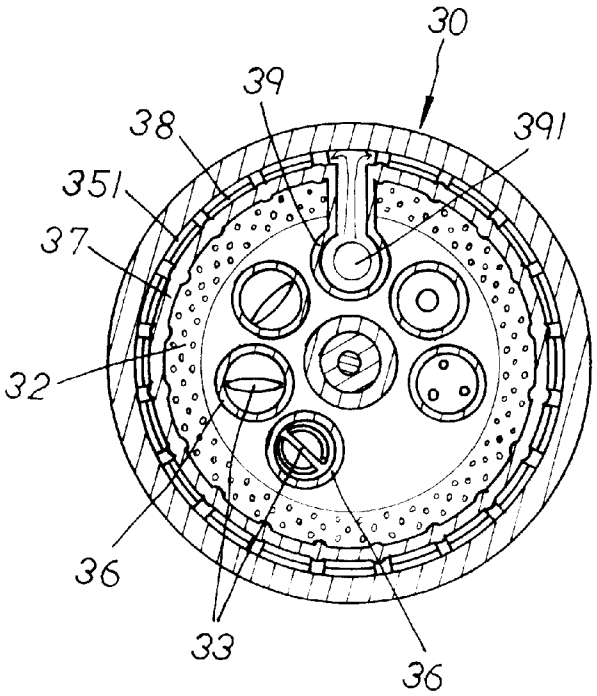

Please refer to FIG. 1. The present invention includes a sprinkling gun 20, a screw 23, a locating spring pin 26, a water sealing O-ring 28, a water discharging cover 30 and a bottom cap 40. The center of the interior of a head section 21 of the sprinkling gun 20 is disposed with a conic post 22 formed with a thread hole. A water exit 24 is formed above the conic post 22. A locating hole 25 is disposed under the conic post 22. A stepped opening 241 is formed in the water exit 24 and spaced from the end face thereof by a certain distance. The inner periphery of the water discharging cover 30 is formed with multiple radially arranged ribs 31 for connecting with a circular screen plate 32. A larger full flow opening 35 is defined between the ribs 31. The exit of each full flow opening 35 is disposed with an inclined flange 351. The periphery of the screen plate 32 is disposed with a rearward extending annular partitioning board 37 having equally interlaced poles. The partitioning board 37 and the inner wall of the water discharging cover 30 define therebetween a full flow water passage 38 (referring to FIG. 2 ). An inner portion of the screen plate 32 is disposed with five different annularly arranged figure sprinkling holes 33 and two blind faces 34 without a sprinkling hole. Each figure sprinkling hole 33 has a rearward extending hollow post 36. One of the blind faces 34 has a rearward extending full flow opening guide flange 39 shaped as a balloon flask and connecting with the partitioning board 37 of the screen plate 32 and communicated with the full flow water passage 38. The full flow opening 35 at the exit of the guide flange 39 is closed. The center of a head section of the guide flange 39 is disposed with a conic projection 391 (as shown in FIG. 4). The bottom cap 40 is disposed with six annularly arranged water entrances 41 and a hollow water incoming post 46 having a circular hole on end face. A back face of the bottom cap 40 is formed with seven locating recesses 45 annularly arranged along the outer periphery thereof corresponding to the water entrances 41 and the hollow water incoming post 46.

Figure 3:
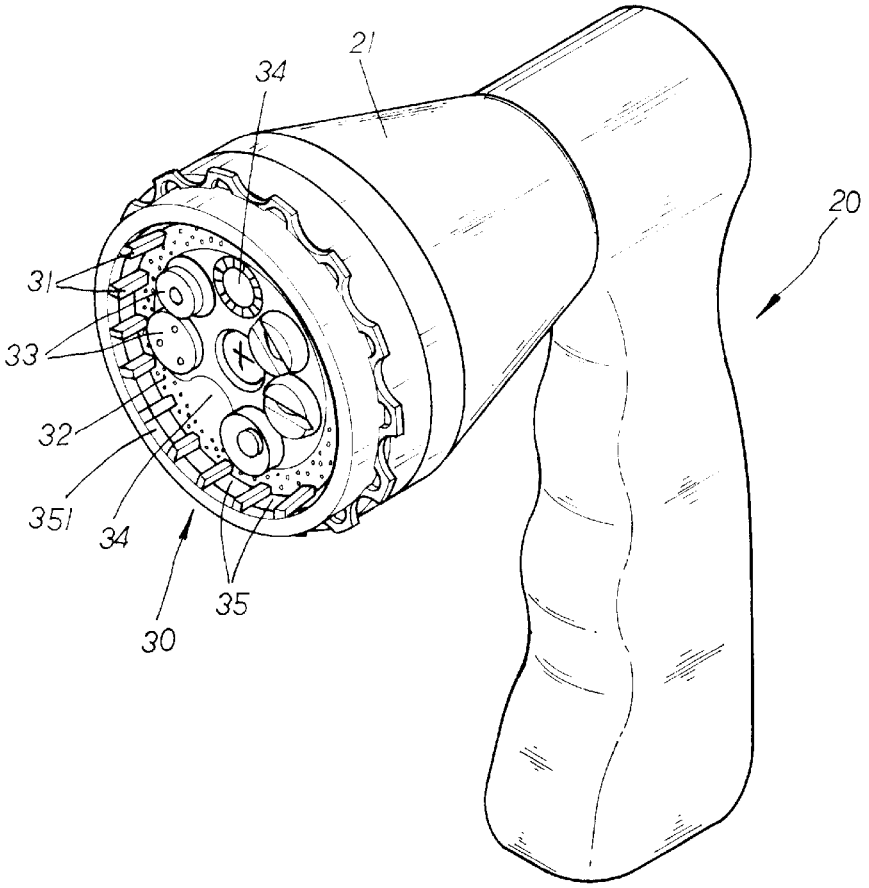
FIG. 3 is a perspective assembled view of the present invention.

FIG. 3 shows the assembly of the present invention. When assembled, the bottom cap 40 is aligned with and fitted with the back face of the water discharging cover 30. The hollow water incoming post 46 of the bottom cap 40 is fitted into one of the hollow posts 36 of the water discharging cover 30. The five water entrances 41 of the bottom cap 40 are leant against the other four hollow posts 36 and the edge of the head section of the guide flange 39 of the water discharging cover 30 and integrally fused therewith by ultrasonic wave to form a figure sprinkling head. The locating spring pin 26 is fitted into the locating hole 25 in the head section 21 of the sprinkling gun 20 and the O-ring 28 is fitted in the stepped opening 27 of the water exit 24 of the head section 21 of the sprinkling gun 20. Then the figure sprinkling head is fitted with the opening of the head section 21 of the sprinkling gun 20. The screw 23 is passed through the central hole of the sprinkling head and screwed into the thread hole of the conic post 22 of the head section 21 of the sprinkling gun 20. The respective water entrances 41 of the bottom cap 48 are fitted and located in the locating recesses 45 of the bottom cap 40 via the locating spring pin 26 and mated with the water exit 24 of the head section 21 of the sprinkling gun 20. The O-ring 28 serves to achieve a watertightly sealing effect and the water is guided and discharged from the figure sprinkling head.

Please refer to FIG. 4. When it is desired to discharge the water from the full flow opening 35, the figure sprinkling head is rotated to align the water entrance 41 of the bottom cap 40 corresponding to the guide flange 39 of the water discharging cover 30 with the water exit 24 of the head section 21 of the sprinkling gun 20. Therefore, the water will flow from the water exit 24 of the sprinkling gun 20 through the water entrance 41 of the bottom cap 40 corresponding to the guide flange 39 to the conic projection 391 in the head section of the guide flange 39 to evenly collect. Then the water is guided by the guide flange 39 to impact the inner wall of the water discharging cover 30 and laterally flow and evenly enter the full flow water passage 38. Then the water is guided by the inclined flange 351 at the exit, of the full flow opening 35 to evenly scatteringly flow to the respective full flow openings 35 and smoothly discharge in an even weak state.

The above description and accompanying drawings are only used to illustrate one embodiment of the present invention. Any modification or variation derived from the embodiment should fall within the scope of the present invention.

What is claimed is:

1. A full flow opening structure of gardening-used figure sprinkling head, comprising a sprinkling gun having a head section connected with a figure sprinkling head, the sprinkling head being composed of a figure water discharging cover and a bottom cap watertightly fused with each other by ultrasonic wave, a conic post formed with thread hole being disposed at a center of interior of the sprinkling gun, the conic post being passed through a central through hole of the figure sprinkling head and connected therewith by a screw, a water exit and a locating hole being formed in a head section of the sprinkling gun, a spring pin being inserted in the locating hole, a stepped opening being formed in the water exit and spaced from an end face thereof by a certain distance, a water sealing O-ring being disposed in the stepped opening, an inner periphery of the water discharging cover being formed with multiple radially arranged ribs for connecting with a circular screen plate, a full flow opening being defined between the ribs, an inner portion of the screen plate being disposed with several different annularly arranged figure sprinkling holes and two blind faces, each figure sprinkling hole having a rearward extending hollow post, the bottom cap being disposed with several annularly arranged water entrances and a hollow water incoming post having a circular hole on end face, a back face of the bottom cap being formed with seven locating recesses annularly arranged along the outer periphery thereof corresponding to the water entrances and hollow water incoming post, said full flow opening structure being characterized in that the exit of each full flow opening is disposed with an inclined flange, the periphery of the screen plate being disposed with a rearward extending annular partitioning board having equally interlaced poles, the partitioning board and the inner wall of the water discharging cover defining therebetween a full flow water passage, one of the blind faces having a rearward extending full flow opening guide flange shaped as a balloon flask and connecting with the partitioning board of the screen plate and communicated with the full flow water passage, the full flow opening at the exit of the guide flange being closed, whereby the figure sprinkling head is rotatable to align the water entrance of the bottom cap corresponding to the guide flange of the water discharging cover with the water exit of the head section of the sprinkling gun, so that the water will flow from the water exit of the sprinkling gun through the water entrance of the bottom cap to the head section of the guide flange to evenly collect, then the water being guided by the guide flange to impact the inner wall of the water discharging cover and laterally flow and evenly enter the full flow water passage, then the water being guided by the inclined flange at the exit of the full flow opening to evenly scatter flow to the respective full flow openings and smoothly discharge in an even weak state.

2. A full flow opening structure of gardening-used figure sprinkling head as claimed in claim 1, wherein a center of the head section of the guide flange of the water discharging cover is disposed with a conic projection.

* * * * *